US006647734B2

(12) United States Patent
Cho et al.

(10) Patent No.: US 6,647,734 B2
(45) Date of Patent: Nov. 18, 2003

(54) AIR CIRCULATION SYSTEM OF REFRIGERATOR

(75) Inventors: Seong Ho Cho, Seoul (KR); In Seop Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 119 days.

(21) Appl. No.: 10/022,499

(22) Filed: Dec. 20, 2001

(65) Prior Publication Data

US 2002/0170300 A1 Nov. 21, 2002

(30) Foreign Application Priority Data

May 16, 2001 (KR) ..... 2001-26601

(51) Int. Cl.[7] ..... F25D 17/06

(52) U.S. Cl. ..... 62/131; 62/256; 62/408; 454/193

(58) Field of Search ..... 62/131, 256, 408, 62/255, 407, 186, 265; 454/188, 189, 191, 193

(56) References Cited

U.S. PATENT DOCUMENTS

| | | | | | |
|---|---|---|---|---|---|
| 2,558,997 | A | * | 7/1951 | Voelker | 62/255 X |
| 4,379,391 | A | * | 4/1983 | Rhee | 62/408 |
| 5,809,799 | A | * | 9/1998 | Jeon | 62/408 |
| 5,875,642 | A | * | 3/1999 | Lee et al. | 62/256 |

* cited by examiner

*Primary Examiner*—Harry B. Tanner
(74) *Attorney, Agent, or Firm*—Birch, Stewart, Kolasch & Birch, LLP

(57) ABSTRACT

The present invention relates to an air circulation system of a refrigerator in a side-by-side refrigerator. The air circulation system ejects a cold air into a refrigerator compartment asymmetrically from right and left side walls to form a vortex thereby enhancing the ability of uniform cooling.

3 Claims, 6 Drawing Sheets

AIR CIRCULATION SYSTEM OF REFRIGERATOR

BACKGROUND OF THE INVENTION

1. Field of the Invention

The invention relates to a refrigerator, and more particularly, to an air circulation system of a refrigerator capable of regulating air to be uniformly flown into a refrigerator compartment.

2. Description of the Related Art

A refrigerator is used to keep foods as frozen or refrigerated and comprised of a housing for defining an accepting space separated into a freezer compartment and a refrigerator compartment therein; doors for the freezer compartment and the refrigerator compartment; and instruments such as a compressor, a condenser and en evaporator for constituting a cooling cycle to form a cold air.

In such a refrigerator, the compressor compresses a cold and low pressure gaseous refrigerant into a hot and high pressure gaseous refrigerant, and the condenser cools and condenses the compressed hot and high pressure gaseous refrigerant to a high pressure liquid, which is towered in temperature and pressure while passing through capillary tubes and then absorbs heat from the surroundings while evaporating into the cold and low pressure gas in the evaporator to cool the surrounding air. The air cooled through the evaporator is introduced and circulated to the freezer compartment and the refrigerator compartment by the operation of a blower fan placed at one side of the evaporator to lower the temperature of the freezer and the refrigerator compartments.

Meanwhile, the refrigerator is provided with an air circulation system for circulating the cold air formed around the evaporator, which is constituted in various configurations according to the refrigerator type.

FIG. 1 shows an example of the air circulation system applied to a side-by-side type refrigerator in which a freezer compartment and a refrigerator compartment are horizontally arranged side-by-side. The air circulation system further comprises a blower fan 20 installed in a blowing chamber 101 in an upper rear section of the freezer compartment 10 and a damper 22 arranged in an upper section of the refrigerator compartment 12 to communicate with the blowing chamber 101.

In this configuration, the blowing chamber 101 is positioned over an evaporator in the rear of the freezer compartment 10 and has an outlet port 10*a* at one side thereof for exhausting a cold air to the freezing compartment 10 (refer to FIG. 2), and the damper 22 has two outlet ports 22*a* in a side section and one outlet port in a lower section (refer to FIG. 3).

According to the air circulation system like this, as shown in FIGS. 2 and 3, the cold air formed around the evaporator is distributed to the freezer compartment 10 and the damper 22 (designated by dot arrows in FIGS. 2 and 3) by the blower fan 20, in which a portion of the cold air exhausted to the freezer compartment 10 circulates within the freezer compartment 10 and then faces toward the evaporator through an air suction port in a lower section of the freezer compartment 10 and the other portion of the cold air introduced to the damper 22 is ejected to the refrigerator compartment 12 through the air outlet ports 22*a* in the side and lower sections.

The cold air ejected to the refrigerator compartment 12 through the damper 22 is introduced to the freezer compartment 10 through a cold air suction port 12*a* in the lower section of the refrigerator compartment 12 to repeat the circulation of passing the evaporator by the blower fan 20.

According to the related art as above, there is an advantage that the cold air in the freezer compartment 10 can be sent to the refrigerator compartment 12 through the damper 22 with a relatively simple configuration thereby allowing the refrigerator to have a simple structure.

However, in the related art as above, since the cold air is concentrically ejected from the upper section of the refrigerator compartment 12 due to the position of the damper (which is positioned over the refrigerator compartment 12), there is a problem that the temperature deviation in the refrigerator compartment 12 may deepen with the upper section being cold and the lower section having a relatively higher temperature so that the cooling operation of the refrigerator compartment 12 may not be performed properly, i.e. foods contained in upper shelves are excessively cooled while those contained in lower shelves are not properly cooled.

SUMMARY OF THE INVENTION

Accordingly, the present invention has been proposed to solve the foregoing problems and it is an object of the invention to provide an air circulation system of a refrigerator comprising: a blower fan provided in a blowing chamber in an upper rear section of a freezer compartment; front air ejecting ports provided in a front section of a partition between the freezer compartment and a refrigerator compartment and communicating to the blowing chamber; rear air ejecting ports provided in a rear section of the refrigerator compartment in the diagonal direction from the front air ejecting port; an air suction port provided in a lower section of the refrigerator compartment and communicating to the freezer compartment; and means for forming a cold air curtain capable of preventing outflow of a cold air when a refrigerator door is opened.

It is preferred that the front and rear air ejecting ports are longitudinally provided, and that the cold air curtain forming means has an air valve for regulating the cold air to be ejected through only the front cold air ejecting ports; an actuator for actuating the air valve; and a control switch for operating the actuator in cooperation with the refrigerator door when the refrigerator door is opened.

DETAILED DESCRIPTION OF THE PREFERRED EMBODIMENT

Figure 1:
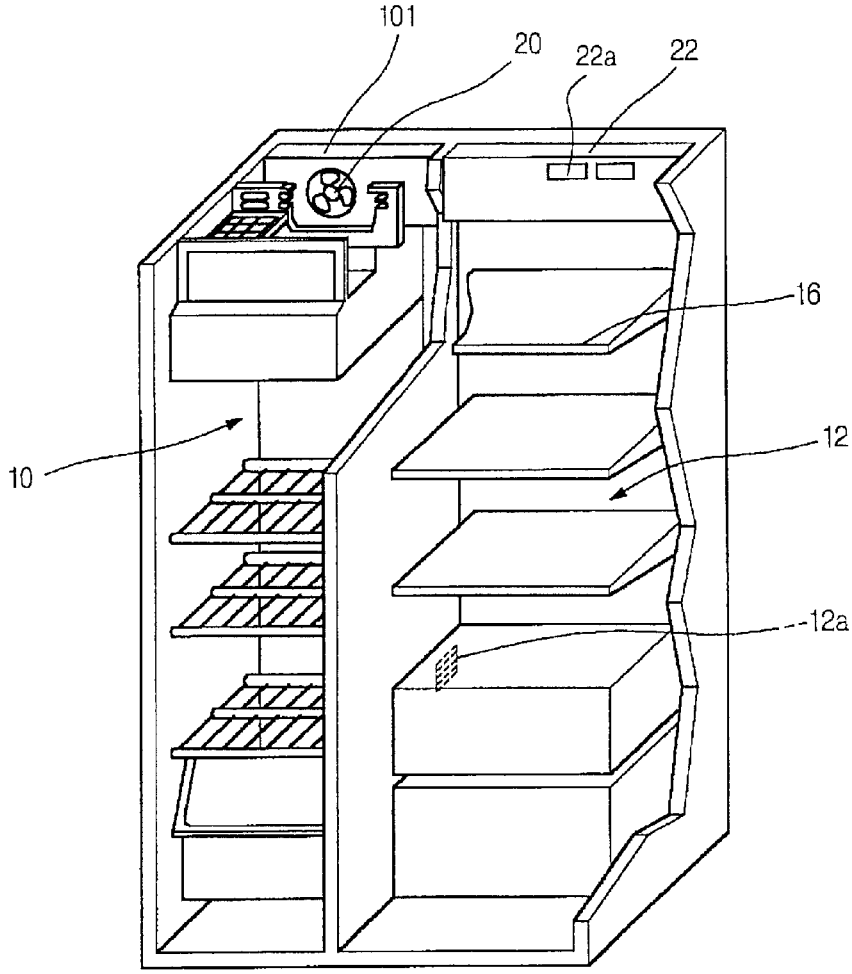
Fig. 1 Related art
FIG. 1 is a perspective view for showing the section in part of a general side-by-side refrigerator structure.
Figure 2:
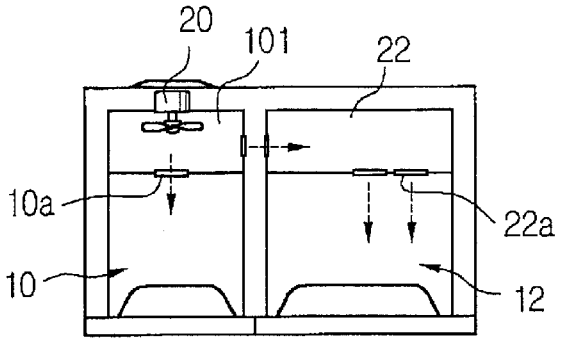
Fig. 2 Related art
FIG. 2 is a plan view of an air circulation system of a refrigerator of the related art.

Hereinafter, detailed description will be made about the embodiment of the invention in reference to FIGS. 4 to 6, in which those components of the invention the same as those of the related art will be imparted with the same reference numerals as those of the related art.

Figure 4:
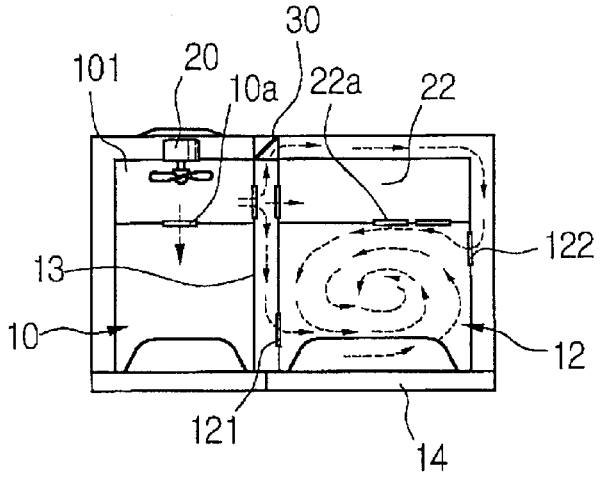
FIG. 4 is a plan view for showing an air circulation system configuration and the circulation of a cold air according to the embodiment of the invention.

An air circulation system of a refrigerator according to the invention, as shown in FIG. 4, comprises a blower fan 20 installed in a blowing chamber 101 in an upper rear section of a freezer compartment 10, front air ejecting ports 121 arranged in a front section of a partition 13 between the freezer compartment 10 and the refrigerator compartment 12 to communicate with the blowing chamber 101, rear air ejecting ports 122 installed in a rear section of the refrigerator compartment 12 in the diagonal direction from the front air ejecting ports 121, an air suction port 12*a* (refer to FIG. 5) arranged in a lower section of the refrigerator compartment 12 to communicate with the refrigerator compartment 10 and means for forming a cold air curtain capable of preventing air outflow when a refrigerator door 14 is opened.

Figure 3:
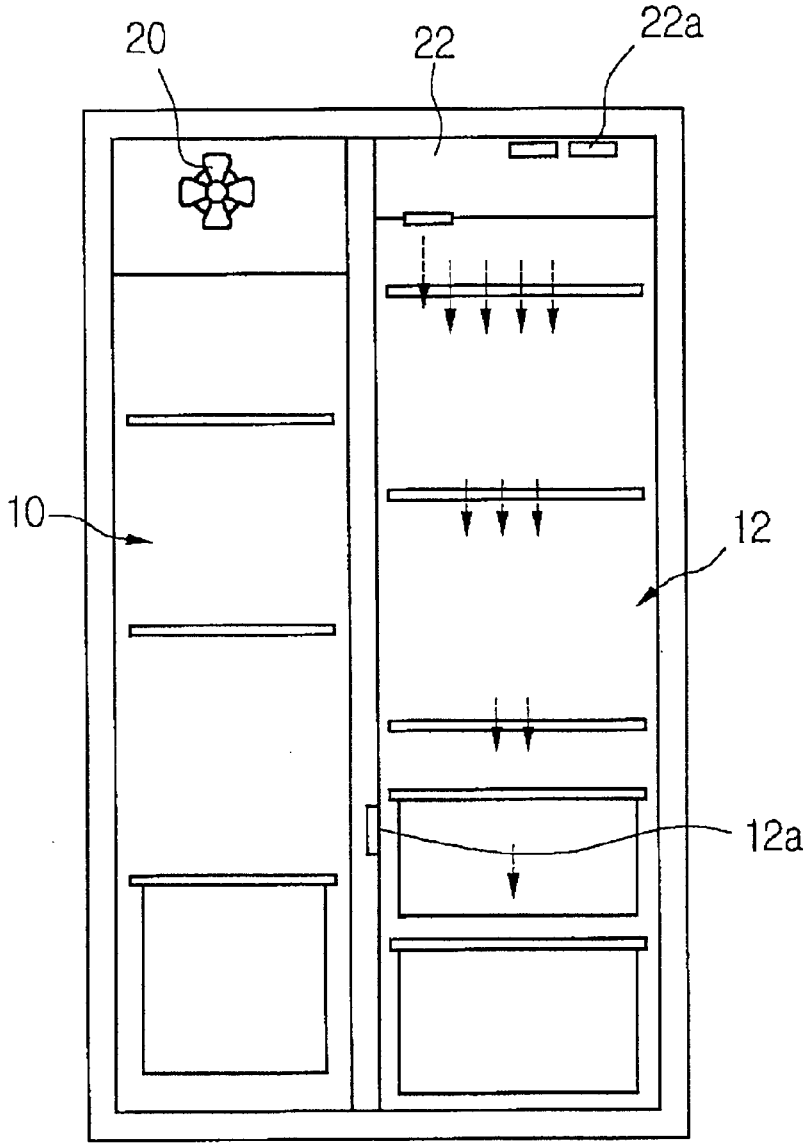
Fig. 3 Related art
FIG. 3 is a front view of an air circulation system of a refrigerator of the related art.

In this case, as shown in FIG. 3, the air ejecting ports 121 and 122 are respectively provided in plurality at a certain interval in the longitudinal direction, and arranged by ones between acceptor shelves S.

Also, the air curtain forming means is constituted by an air valve 30 (refer to FIG. 4) arranged in the blowing chamber 101 for selectively interrupting the air directing toward the rear air ejecting ports 122 to allow the air to be ejected through only the front air ejecting ports 121, an actuator (not shown) for actuating the air valve 30 and a control switch (not shown) connected to the refrigerator door 14 for actuating the actuator when the refrigerator door 14 is opened.

The air circulation system according to the embodiment of the invention described above will be operated as in the following description.

First, as the refrigerator door 14 is closed, the air introduced from the blowing chamber 101 is ejected simultaneously from the front air ejecting ports 121 and the rear air ejecting ports 122 to form a vortex in the middle of the refrigerator compartment 12 (refer to FIG. 4).

Figure 5:
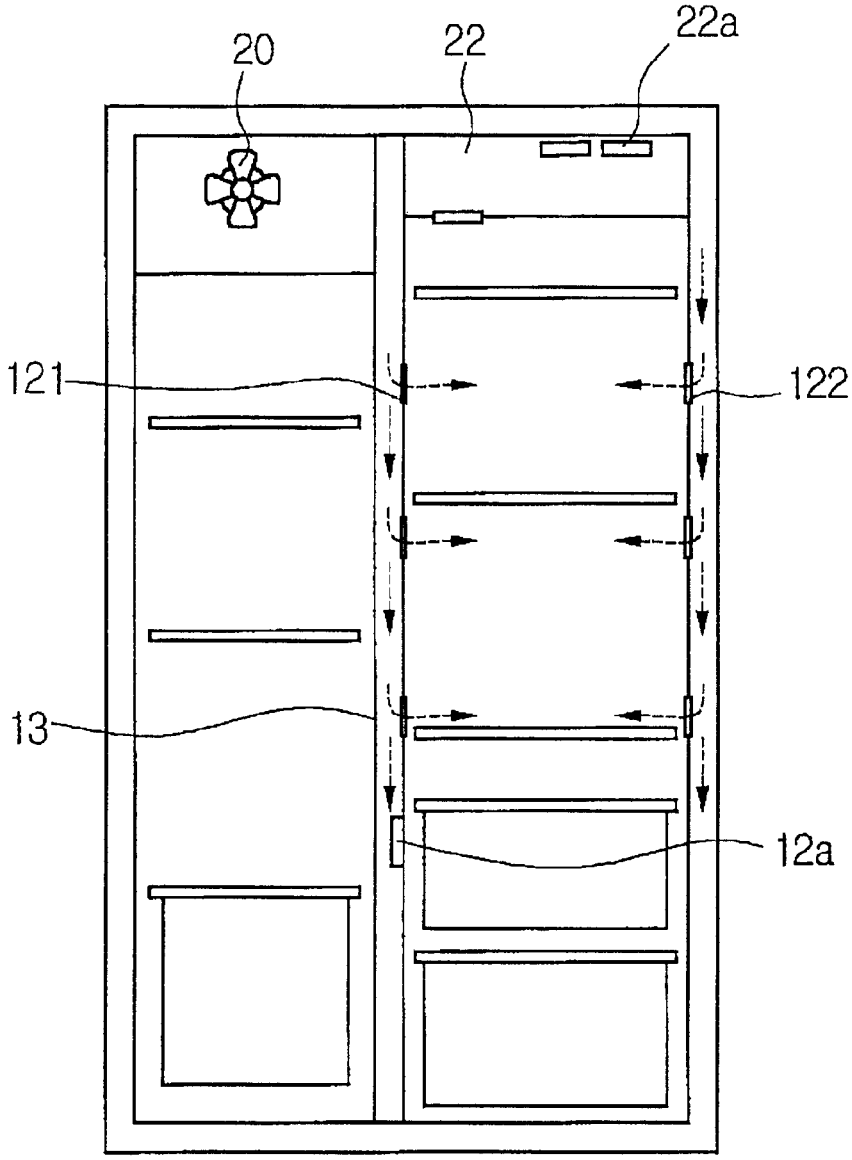
FIG. 5 is a front view for showing an air circulation system configuration and the circulation of a cold air according to the embodiment of the invention.

Also, considering the configuration of the both air ejecting ports 121 and 122 arranged in a vertically longitudinal manner between the shelves, the ejected air is not lopsidedly distributed but ejected between the each shelf S and uniformly distributed to each region of the refrigerator compartment 12 accordingly preventing a problem that the foods contained in a specific section of the refrigerator compartment 12 is excessively cooled (refer to FIG. 5).

A cold air ejected to the refrigerator compartment 12 is introduced into the freezer compartment again through the air suction port 12*a* in the lower section to continue circulation.

Figure 6:
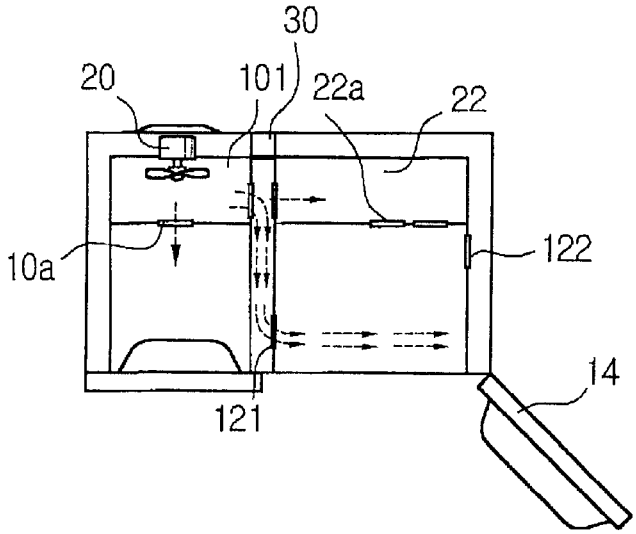
FIG. 6 is a plan view for showing the circulation of a cold air when a refrigerator door is opened according to the embodiment of the invention.

Then, as shown in FIG. 6, when the refrigerator door 14 is opened, for example, to take out the foods contained in the refrigerator compartment 12, the control switch connected to the refrigerator door 14 operates the actuator so that the air value 30 may shut channels leading to the rear air ejecting ports 122.

When the channels leading to the rear air ejecting ports 122 are shut like this, the cold air is strongly ejected only from the front air ejecting ports 121 to form the so-called cold air curtain, which isolates the inside of the refrigerator compartment 12 from the outside as a strong air flow, so as to effectively prevent a phenomenon that the cold air is flown out from the refrigerator compartment 12 and the outer air is introduced to raise the temperature of the refrigerator compartment 12.

According to the air circulation system of the refrigerator of the invention as described hereinbefore, the cold air introduced into the refrigerator compartment forms the vortex to be uniformly distributed to the whole section in the refrigerator compartment and the cold air curtain is formed in the front section of the refrigerator compartment to prevent outflow of the cold air when the refrigerator door is opened so that the cooling operation of the refrigerator compartment can be effectively carried out accordingly providing an advantage that the contained foods can be kept fresh more effectively.

What is claimed is:

1. An air circulation system of a refrigerator comprising:

a blower fan provided in a blowing chamber in an upper rear section of a freezer compartment;

front air ejecting ports provided in a front section of a partition between the freezer compartment and a refrigerator compartment and communicating to the blowing chamber;

rear air ejecting ports provided in a rear section of the refrigerator compartment in the diagonal direction from said front air ejecting port;

an air suction port provided in a lower section of the refrigerator compartment and communicating to the freezer compartment; and means for forming a cold air curtain capable of preventing outflow of a cold air when a refrigerator door is opened.

2. The air circulation system according to claim 1, wherein said front and rear air ejecting ports are vertically provided in plurality with a gap, and arranged by ones between each acceptor shelf.

3. The air circulation system according to claim 1, wherein said cold air curtain forming means has:

an air valve provided in the blowing chamber for selectively shutting channels leading to said rear cold air ejecting ports so that the cold air is ejected through only said front cold air ejecting ports;

an actuator for actuating said air valve; and a control switch for operating said actuator in cooperation with the refrigerator door when the refrigerator door is opened.

* * * * *